US005167608A

United States Patent [19]

Steffens, Jr. et al.

[11] Patent Number: 5,167,608

[45] Date of Patent: Dec. 1, 1992

[54] BAG SEVERING AND SEALING APPARATUS

[76] Inventors: Leonard Steffens, Jr.; Donna M. Steffens, both of Rte. 1, Box 351, Claremore, Okla. 74017

[21] Appl. No.: 772,108

[22] Filed: Oct. 7, 1991

[51] Int. Cl.[5] ..... B65D 33/24; B31B 1/90; B65B 61/18

[52] U.S. Cl. ..... 493/214; 383/64; 383/66; 383/202; 53/133.4; 53/381.2; 24/400; 24/415

[58] Field of Search ..... 24/400, 415; 53/133.1, 53/133.3, 133.4, 381.2; 206/603; 229/204, 308; 383/63, 64, 66, 202; 493/214, 923, 927, 962, 963

[56] References Cited

U.S. PATENT DOCUMENTS 1,703,712 2/1929 Aud ..... 383/64

2,994,469 8/1961 Troup et al. ..... 383/202

FOREIGN PATENT DOCUMENTS 2636923 3/1990 France ..... 383/64

*Primary Examiner*—William E. Terrell

*Attorney, Agent, or Firm*—Leon Gilden

[57] ABSTRACT

A flexible plate member is arranged for adherence to a bag member, wherein the plate member includes an adhesive strip mounted to a bottom surface thereof, and the plate member including interlocking zipper webs securable selectively by a zipper slidably mounted in intercommunication between the first and second webs, wherein the zipper member includes a severing plunger rod reciprocatably mounted within the zipper orthogonally oriented relative to the plate member to effect initial severing of an associated bag web subsequent to the plate member adhered to the bag web outer surface.

2 Claims, 4 Drawing Sheets

PRIOR ART

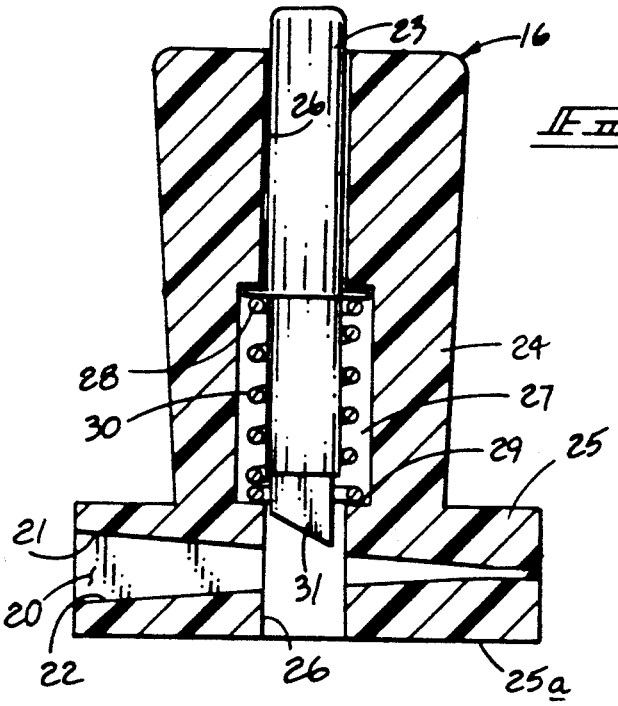
Fig 6
Fig 7
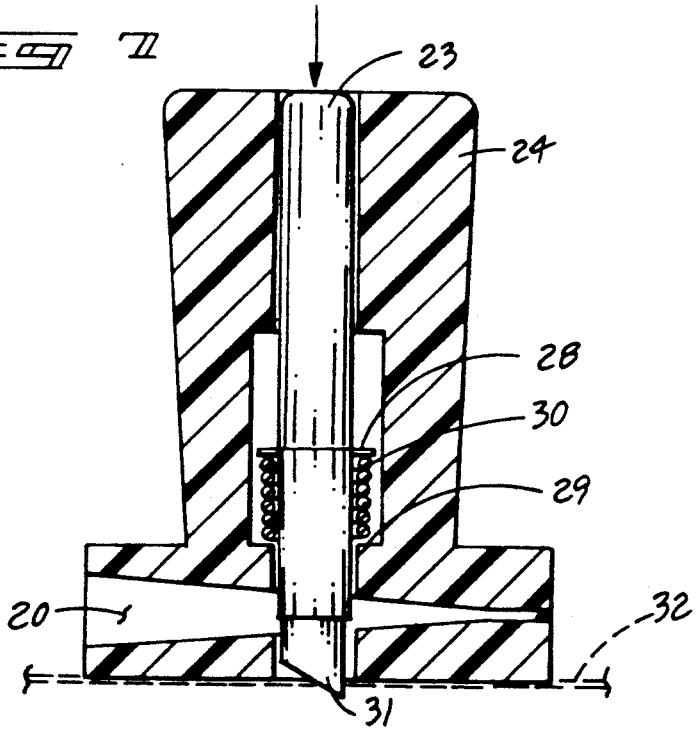
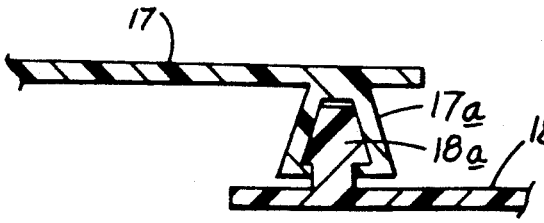
Fig 8

BAG SEVERING AND SEALING APPARATUS

BACKGROUND OF THE INVENTION

1. Field of the Invention

The field of invention relates to bag sealing apparatus, and more particularly pertains to a new and improved bag severing and sealing apparatus wherein the same permits the severing and resealing capability of commercially available bags without undue recourse to containers and the like to contain associated food components therewithin.

2. Description of the Prior Art

Bag sealing apparatus of various types are utilized in the prior art to contain food components. Such apparatus is exemplified in U.S. Pat. No. 4,923,701 to Vanerden; U.S. Pat. No. 4,878,763 to Ausnit; U.S. Pat. No. 4,929,225 to Ausnit, et al.; and U.S. Pat. No. 4,792,240 to Ausnit all providing for zipper-like structure for securement of free-end web portions of an associated bag structure. The prior art structure, however, has failed to provide for an organization to utilize materials to a minimum and thereby permit utilization of an original container for the selective storage of food components therewithin.

As such, it may be appreciated that there continues to be a need for a new and improved bag severing and sealing apparatus as set forth by the instant invention which addresses both the problems of ease of use as well as effectiveness in construction and as such, the present invention substantially fulfills this need.

SUMMARY OF THE INVENTION

In view of the foregoing disadvantages inherent in the known types of bag sealing apparatus now present in the prior art, the present invention provides a bag severing and sealing apparatus wherein the same utilizes a housing member including adhering structure to permit its selective securement to an associated bag structure. As such, the general purpose of the present invention, which will be described subsequently in greater detail, is to provide a new and improved bag severing and sealing apparatus which has all the advantages of the prior art bag sealing apparatus and none of the disadvantages.

To attain this, the present invention provides a flexible plate member arranged for adherence to a bag member, wherein the plate member includes an adhesive strip mounted to a bottom surface thereof, and the plate member including interlocking zipper webs securable selectively by a zipper slidably mounted in intercommunication between the first and second webs, wherein the zipper member includes a severing plunger rod reciprocatably mounted within the zipper orthogonally oriented relative to the plate member to effect initial severing of an associated bag web subsequent to the plate member adhered to the bag web outer surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bag severing and sealing apparatus which has all the advantages of the prior art bag sealing apparatus and none of the disadvantages.

It is another object of the present invention to provide a new and improved bag severing and sealing apparatus which may be easily and efficiently manufactured and marketed.

It is a further object of the present invention to provide a new and improved bag severing and sealing apparatus which is of a durable and reliable construction.

An even further object of the present invention is to provide a new and improved bag severing and sealing apparatus which is susceptible of a low cost of manufacture with regard to both materials and labor, and which accordingly is then susceptible of low prices of sale to the consuming public, thereby making such bag severing and sealing apparatus economically available to the buying public.

Still yet another object of the present invention is to provide a new and improved bag severing and sealing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic cross-sectional view, taken along the lines 6—6 of FIG. 5 in the direction indicated by the arrows.

FIG. 7 is an orthographic sie view of the zipper structure in a configuration wherein the cutter is projected into the associated bag member web.

FIG. 8 is an orthographic view, taken along the lines 8—8 of FIG. 4 in the direction indicated by the arrows.

DESCRIPTION OF THE PREFERRED EMBODIMENT

Figure 1:
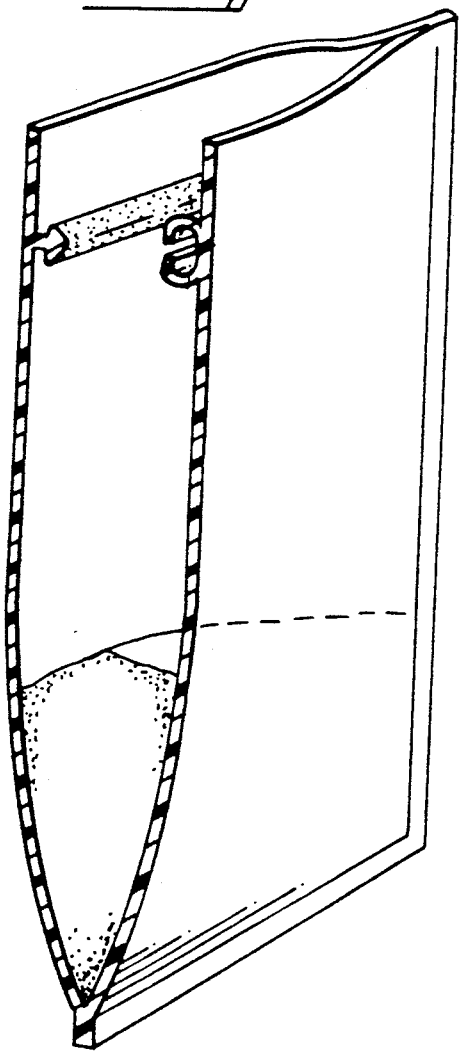
FIG. 1 is an isometric cross-sectional illustration of a prior art bag structure.

With reference now to the drawings, and in particular to FIGS. 1 to 10 thereof, a new and improved bag severing and sealing apparatus embodying the principles and concepts of the present invention and generally designated by the reference numeral 10 will be described.

Figure 2:
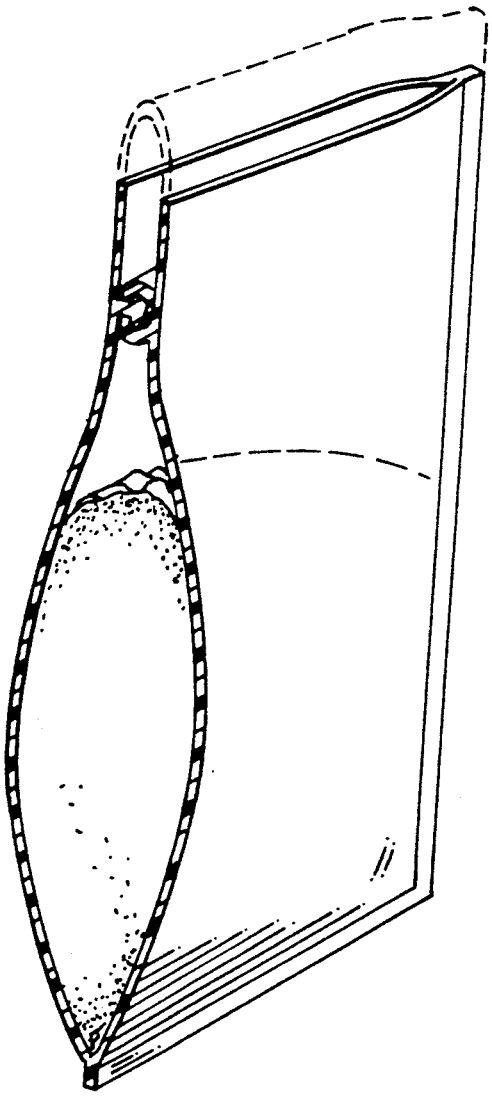
PRIOR ART Fig 2
FIG. 2 is an isometric illustration of the bag structure of FIG. 1 in a closed configuration.
Figure 3:
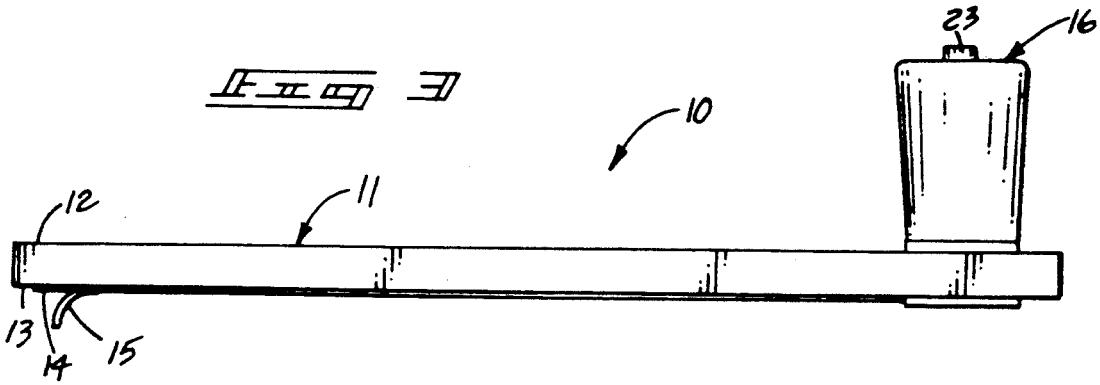
FIG. 3 is an orthographic side view of the instant invention.
Figure 4:
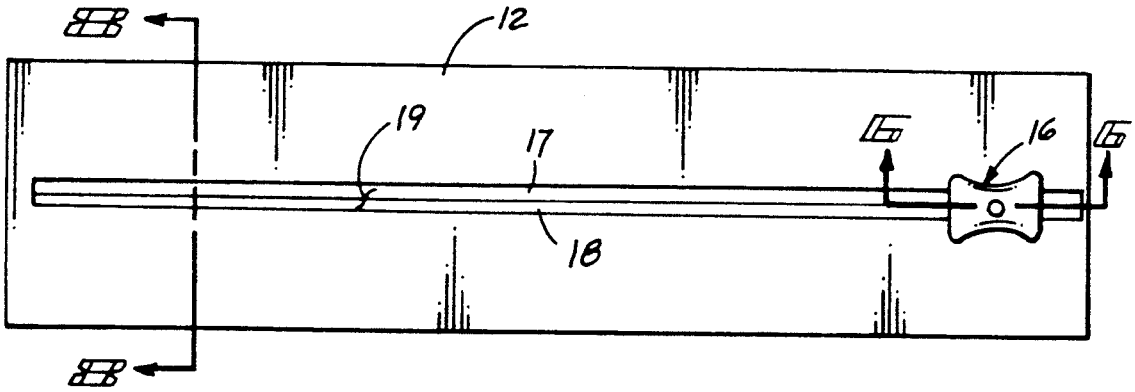
FIG. 4 is an orthographic top view of the instant invention.
Figure 5:
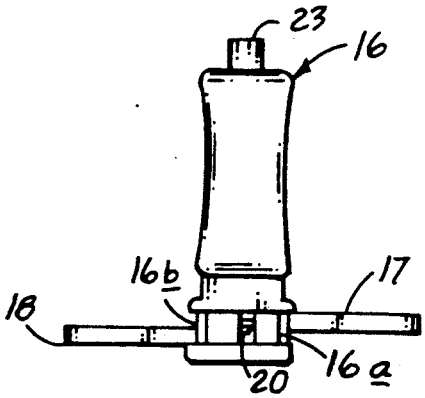
FIG. 5 is an orthographic end view of the instant invention.

The FIGS. 1 and 2 illustrate a typical prior art bag closure structure as set forth in U.S. Pat. No. 4,923,701 illustrating the bag structure in a respective open and closed configuration and the inter-relationship of the closure webs, as illustrated.

Figure 9:
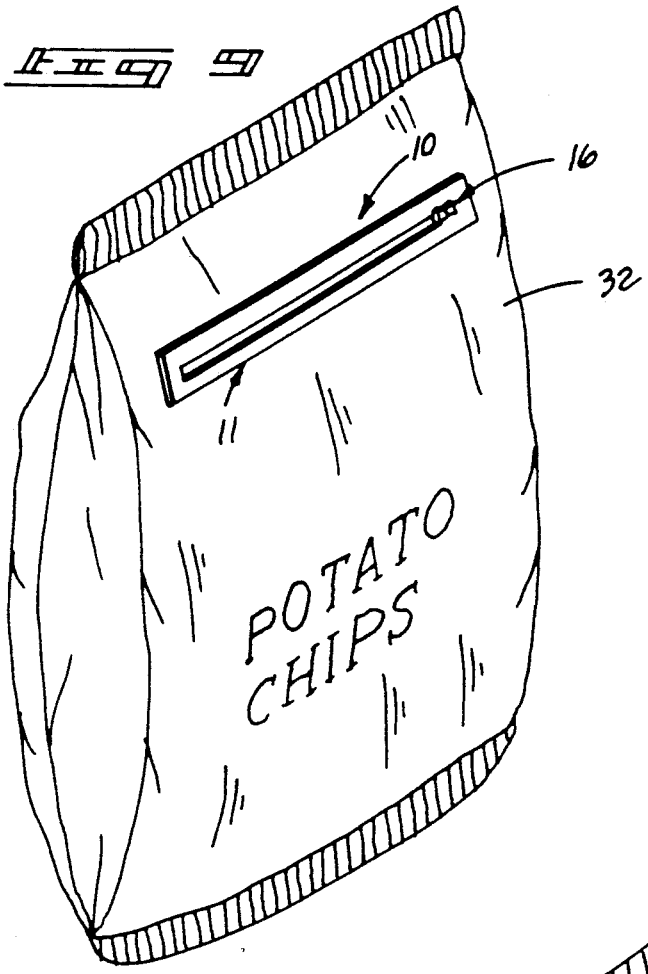
FIG. 9 is an isometric illustration of the invention mounted to an associated bag structure.
Figure 10:
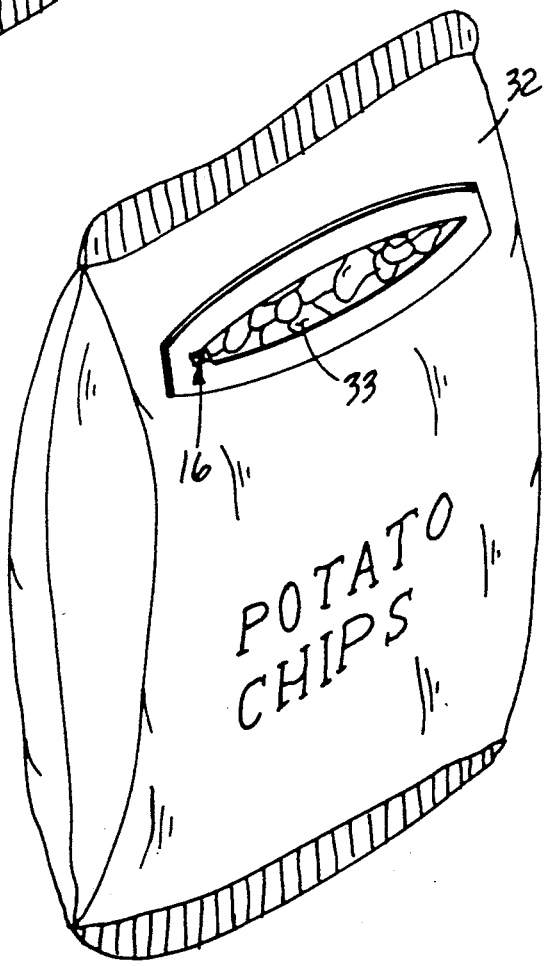
FIG. 10 is an isometric illustration of the invention mounted to the bag structure illustrating an access opening available for access to food components within the bag structure.

More specifically, the bag severing and sealing apparatus 10 of the instant invention essentially comprises a flexible plate member 11 that includes a plate member top wall 12 spaced from and parallel a bottom wall 13. An adhesive web 14 is mounted substantially coextensive to the bottom wall 13, wherein an enclosed slot 19 is directed through the plate member 11 from the top wall to the bottom wall and directed through the adhesive web 14. The adhesive web 14 initially includes a peel-away protective layer 15 to provide for selective exposure of the adhesive for permitting selective securement of the adhesive web onto a bag member wall 32, as illustrated in FIGS. 9 and 10 for example. The slot 19 includes cooperative first and second lock webs 17 and 18 each mounting a respective first and second lock web latch member 17*a* and 18*a* for intercommunication relative to one another, in a manner as illustrated in FIG. 8 for example. A zipper assembly 16 mounted within the slot 19 is arranged for longitudinal translation along the slot 19 to effect separation and closure of the cooperative first and second lock webs 17 and 18. The zipper assembly 16 includes a zipper first bore 20 directed through a zipper base 25, with the first bore 20 including a first bore top wall 21 and a first bore bottom wall 22 that converge towards one another for an entrance opening and are, as illustrated, canted relative to one another from the entrance opening rearwardly to the exit opening to effect securement of the latch members 17*a* and 18*a*, as illustrated. A zipper second bore 26 orthogonally intersecting the first bore is of a cylindrical configuration and includes a plunger rod 23 reciprocatably mounted within the second bore. The second bore is contained within a housing 24 orthogonally and fixedly mounted to the base 25. The zipper housing 24 includes a housing lower cavity 27 coaxially aligned within the bore relative to the second bore 26 and the housing 24 to contain a captured spring 30 captured between a lower cavity floor 29 and a plunger rod flange 28 fixedly mounted about the plunger rod, whereupon depressing of the plunger rod 23 into the second bore 26 projects the cutter plate 31 from a first position spaced above the first bore 20, and specifically the first bore top wall 21, to a second position projecting below a base floor 25*a* to effect contact and communication of the cutter plate 31 with the bag member wall 32, whereupon mounting of the plate member 11 to the exterior surface of the bag wall 32 permits initial severing of the bag member wall by the cutter plate 31, whereupon subsequently the zipper assembly 16 is utilized for effective securement of the first and second lock webs together, as required, to effect closure of an entrance opening 33 directed through the slot 19 of the bag member 32 for access to components therewithin, whereupon subsequently, the lock flanges may be secured together by use of the zipper construction. The zipper is mounted to the lock webs by any of numerous associations, but may include the mounting rods 16*a* and 16*b* directed through the first and second lock webs 17 and 18 spaced from the lock flanges, wherein these rods are arranged for guided containment within the webs 17 and 18 during trasverse of the zipper assembly within the slot 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bag severing and sealing apparatus for securement to a bag member, wherein the bag member includes a bag member wall and wherein the apparatus comprises, a flexible plate member, the flexible plate member including a plate member top wall spaced from and parallel a plate member bottom wall, and an enclosed slot directed medially and longitudinally of the plate member extending from the plate member top wall to the plate member bottom wall, and wherein the slot includes a first lock web selectively securable to a second lock web, and a zipper assembly mounted to the first lock web and second lock web for selective securement of the first lock web and the second lock web together, and cutter means mounted within the zipper assembly for selective severing of the bag member wall, and the zipper assembly includes a zipper base mounted within the slot, and a zipper housing integrally and orthogonally mounted to the base, the zipper base including a base bottom wall projecting below the plate member bottom wall, and the zipper base including a first bore directed therethrough, the first bore including a first bore top wall and a first bore bottom wall and an entrance opening, wherein the first bore top wall and the first bore bottom wall converge towards one another within the zipper base to effect selective securement of the first lock web and second lock web together, and a second bore directed through the zipper housing, wherein the second bore intersects the first bore and the second bore is orthogonally oriented relative to the first bore, and the cutter means including a plunger rod reciprocatably mounted within the second bore, wherein the plunger rod includes a cutter plate mounted to a lower terminal end of the plunger rod, wherein the cutter plate is positioned above the first bore top wall in a first position and wherein the cutter plate extends below the zipper base bottom wall in a second position when the plunger rod is projected into the second bore, and a lower cavity mounted within the zipper housing, wherein the lower cavity as coaxially aligned with the second bore and the second bore is directed through the lower cavity, where the lower cavity is positioned within the zipper housing extending from the zipper base to a lower cavity position spaced from the zipper housing top wall, and the plunger rod includes a flange member extending radially exteriorly of the plunger rod and contained within the lower cavity, and the lower cavity includes a lower cavity floor, with a spring member captured between the flange and the lower cavity floor to bias the plunger rod in the first position.

2. An apparatus as set forth in claim 1 including an adhesive web mounted to the plate member bottom wall, wherein the adhesive web includes a peel-away protective layer mounted to the adhesive web and arranged for selective removal relative to the adhesive web for selective exposure of the adhesive web and securement of the adhesive web to the bag member wall.

* * * * *